US005287809A

United States Patent [19]

Greive

[11] Patent Number: 5,287,809

[45] Date of Patent: Feb. 22, 1994

[54] METHOD AND DEVICE FOR FEEDING, ALIGNING AND HOLDING A SHEET ON A SHEET-PROCESSING MACHINE

[75] Inventor: Martin Greive, Heidelberg, Fed. Rep. of Germany

[73] Assignee: Heidelberger Druckmaschinen AG, Heidelberg, Fed. Rep. of Germany

[21] Appl. No.: 877,865

[22] Filed: May 4, 1992

[30] Foreign Application Priority Data

May 3, 1991 [DE] Fed. Rep. of Germany ..... 4114479

[51] Int. Cl.[5] ..... B41F 9/00; B65H 9/04

[52] U.S. Cl. ..... 101/485; 101/142; 271/82; 271/204; 271/243

[58] Field of Search ..... 101/142, 137, 154, 246, 101/217, 218, 177, 409, 410, 411, 485; 271/241, 243, 244, 242, 204, 82

[56] References Cited

U.S. PATENT DOCUMENTS

| | | | |
|---|---|---|---|
| 1,155,505 | 10/1915 | Niles | 101/142 |
| 1,916,454 | 7/1933 | Wohlrabe | 101/246 |
| 2,201,726 | 5/1940 | Grundhoefer | 271/243 |
| 2,374,668 | 5/1945 | Davidson | 101/142 |
| 2,638,342 | 5/1953 | Luehrs | 271/243 |
| 4,471,695 | 9/1984 | Ishii | 101/217 |
| 4,756,245 | 7/1988 | Roch | 101/246 |
| 5,088,404 | 2/1992 | MacConnell | 101/246 |
| 5,103,733 | 4/1992 | Drapatsky et al. | 101/246 |

FOREIGN PATENT DOCUMENTS

| | | | |
|---|---|---|---|
| 1761435 | 10/1970 | Fed. Rep. of Germany . | |
| 3229433 | 2/1983 | Fed. Rep. of Germany . | |
| 3117855 | 9/1984 | Fed. Rep. of Germany . | |
| 3629003 | 3/1987 | Fed. Rep. of Germany . | |
| 2360 | of 1914 | United Kingdom | 101/142 |
| 1194135 | 6/1970 | United Kingdom . | |
| 2061882 | 5/1981 | United Kingdom | 101/246 |

*Primary Examiner*—Engene H. Eickholt

*Attorney, Agent, or Firm*—Herbert L. Lerner; Laurence A. Greenberg

[57] ABSTRACT

A method of feeding, aligning and holding a sheet on a cylinder of a sheet-processing machine, which includes, prior to an occurrence of a gripping operation on a sheet at a cylinder of a sheet-processing machine, forcing a leading edge of the sheet into a contact position wherein the leading edge of the sheet is pressed against moving front lays which are guided over the cylinder, opening sheet grippers carried by the cylinder, inserting the leading edge of the sheet which is in the contact position into the sheet grippers, and maintaining the leading edge of the sheet in the contact position with the front lays until just before closing the sheet grippers; and a device for performing the method.

17 Claims, 4 Drawing Sheets

METHOD AND DEVICE FOR FEEDING, ALIGNING AND HOLDING A SHEET ON A SHEET-PROCESSING MACHINE

The invention relates to a method for feeding, aligning and holding a sheet on a cylinder of a sheet-processing machine, particularly a sheet-fed printing press, wherein a leading edge of the sheet comes into contact with front lays and is then fed to grippers.

In order to achieve trouble-free results on sheet-processing machines, it is necessary always to ensure that the sheets are fed, aligned and held clamped in a reproducible manner. In a sheet-fed printing press, a printed image will be in the same position on the sheets at all times only if the sheets are always held in an identical, defined position on the cylinder.

From German Published Non-Prosecuted Application (DE-OS) 17 61 435, a process has become known wherein the sheets are aligned by means of front lays and are transported up to a pre-gripper. The pre-gripper then transfers the respective sheet to cylinder grippers. This sheet transfer requires an elaborate technology and may, furthermore, lead to alignment errors, i.e., undesired shifting or displacement of the sheet can be expected.

German Published, Non-Prosecuted Application (DE-OS)36 29 003 discloses an offset sheet-fed printing press which has chain-wheels or sprockets which are disposed laterally with respect to the cylindrical surface of an impression cylinder. Chains extend over the sprockets and are provided with grippers. The gripper system consequently runs past the cylinder laterally. Play in the chain may cause alignment errors.

From German Patent 31 17 855, a gripper system has become known heretofore wherein grippers dip into recesses formed in a cylinder. If the grippers do not grip the respective sheet in the correct position, this incorrect alignment will persist during the passing of the cylinder.

With the device heretofore known from German Published, Non-Prosecuted Application (DE-OS) 32 29 433, feed rollers feed the respective sheet to grippers of a cylinder. The sheet is aligned when the edge of the sheet strikes against a stop member on a sheet holder. The feed rollers assume the role of the aforementioned pre-grippers.

It is accordingly an object of the invention to provide a method and device of the foregoing general type wherein sheets are transferred to the cylinder of a sheet-processing machine in a position which is always reproducible. This should be possible in particular by simple means. With the foregoing and other objects in view, there is provided, in accordance with the invention, a method of feeding, aligning and holding a sheet on a cylinder of a sheet-processing machine, which comprises, prior to an occurrence of a gripping operation on a sheet at a cylinder of a sheet-processing machine, forcing a leading edge of the sheet into a contact position wherein the leading edge of the sheet is pressed against moving front lays which are guided over the cylinder, opening sheet grippers carried by the cylinder, inserting the leading edge of the sheet which is in the contact position into the sheet grippers, and maintaining the leading edge of the sheet in the contact position with the front lays until just before closing the sheet grippers. Consequently, when the sheet is being transported to the cylinder, the sheet remains in a constant contact position with respect to the front lays which, also while the appropriate sheet edge is being introduced into the open grippers, continue to ensure a precise alignment of the sheet by maintaining the contact position thereof until the grippers close.

This ensures a steady transfer of the sheet, i.e., without acceleration and shocks or jolts, in defined, reproducible alignment on the cylinder of the sheet-processing machine. There is no need to stop the machine in order to align the sheet. After the alignment, no further transfer of the sheet occurs in order to ensure its final arrival at the cylinder of the sheet-processing machine. According to the process according to the invention, it is possible to achieve faultless results also at high press speeds. With a single-sheet feeder and front and, if necessary or desirable also lateral alignment of the sheets, it is quite possible to attain speeds of 10,000 copies/hour and higher without any problem. The continuous contact of the leading edge of the sheet against the front lays ensures that the sheet is correctly aligned and remains in this correct position until the grippers close. Thus, the sheets are held in constantly reproducible position by the grippers.

In accordance with another mode, the method of the invention includes guiding the front lays around the cylinder.

In accordance with a further mode, the method of the invention includes moving the front lays between the grippers when inserting the leading edge of the sheet into the grippers. In this regard, the sheet is continually driven against the moving front lays by the sheet-transport device.

In accordance with an added mode, the method according to the invention includes moving the sheet at a speed higher than the speed of the front lays while continuously braking the higher speed of the sheet against the front lays. in accordance with an additional mode, the method of the invention includes laterally aligning the sheet while its leading edge is in the contact position with the front lays and prior to closing the grippers. Thus the alignment of the leading edge of the sheet is therefore maintained during the lateral alignment, leading thereby to trouble-free results.

In accordance with another aspect of the invention, there is provided a device for feeding, aligning and holding a sheet on a cylinder of a sheet-processing machine, comprising means for feeding a sheet, means including front lays for aligning the sheet at a leading edge thereof, and gripper means having open grippers closable for gripping the sheet at a leading-edge portion thereof, a leading edge of the sheet being feedable by the feeding means into contact with the front lays of the aligning means, and a leading-edge portion of the sheet being insertable into the open grippers while the leading edge of the sheet remains in contact with the front lays of the aligning means and prior to a closing of the open grippers.

In accordance with a first alternate feature of the invention, the sheet-feeding means are a sheet transport device formed as an endless conveyor belt.

In accordance with a second alternate feature of the invention, the sheet-feeding means are a sheet transport device formed as a suction device.

In accordance with a third alternate feature of the invention, the sheet-feeding means are a transport device having a directed air cushion.

These alternate features always ensure that the leading edge of the sheet is continuously in contact position with the front lays. For this purpose, the sheet is continuously driven against the front lays at a speed which is greater than the speed at which the front lays are being driven.

In accordance with another feature of the invention, the aligning means comprise a conveyor-belt device running over the cylinder.

In accordance with a further feature of the invention, the conveyor-belt device comprises two parallel, synchronously revolving endless belts, and at least one aligning bridge connecting the conveyor belts to one another, the aligning bridge being formed with the front lays. In particular, a guide wheel for each of the two belts is provided at each of the two ends of the cylinder.

In accordance with an added feature of the invention, the aligning bridge is movable past the cylinder, the cylinder is formed with a holding recess, and the aligning bridge is formed with a bridge cross-piece receivable in the holding recess with a precise fit when the aligning bridge passes the cylinder. The precisely fitting reception or entry of the bridge cross-piece in the holding recess can be achieved by appropriately shaping the bridge cross-piece and the holding recess; alternatively, however, it is also possible to effect the precise fit, by special alignment means on the aligning bridge or on the front lays and the cylinder. Assurance is thereby constantly provided that the front lays will assume a defined position with respect to the cylinder, because of which the sheet, too, then has a defined position with respect to the cylinder.

In accordance with an additional feature of the invention, the cylinder is an impression cylinder of a sheet-fed printing machine.

In accordance with yet another feature of the invention, the gripper means comprise a plurality of grippers mutually spaced apart in rows.

In accordance with yet a further feature of the invention, the aligning bridge has a comb-like shape, the front lays thereof forming stops and being disposed on a plurality of spaced-apart prong-like projections of the comb-like aligning bridge. When the bridge cross-piece dips into the holding recess, the projections are introduced or enter between the grippers. In order to prevent the leading edge of the sheet from slipping off the respective front lay, each front lay is preferably provided with a hold-down lug, in accordance with yet an added feature of the invention.

In accordance with a concomitant feature of the invention, there are provided a gripper mechanism for opening and closing the grippers, a fixed cam plate, and a sensing member operatively connected to the gripper mechanism and movable along the fixed cam plate by rotation of the cylinder for operating the gripper mechanism.

Other features which are considered as characteristic for the invention are set forth in the appended claims.

Although the invention is illustrated and described herein as embodied in a method and device for feeding, aligning and holding a sheet on a sheet-processing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
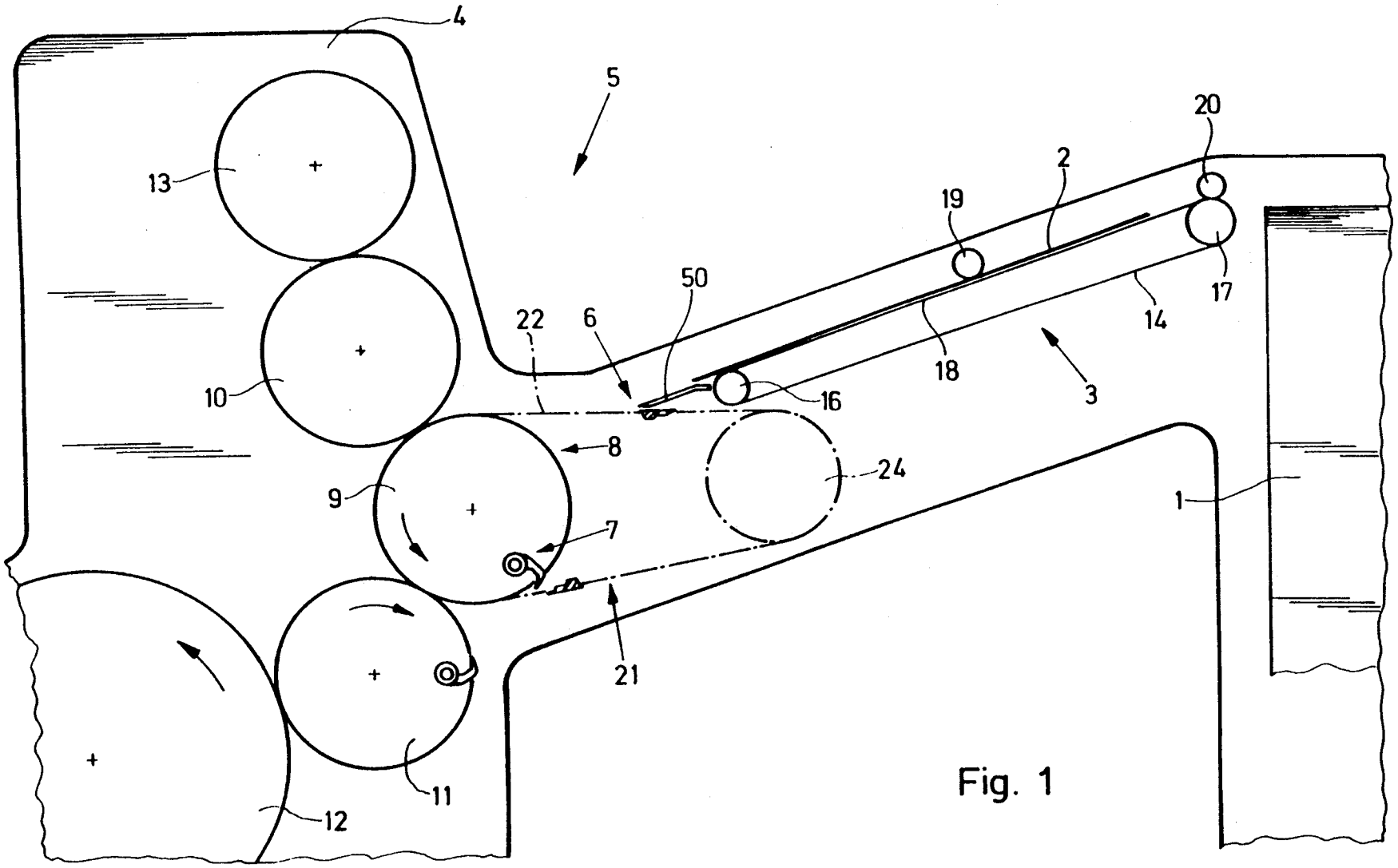
FIG. 1 is a diagrammatic side elevational view of a sheet-feeding system of a sheet-fed printing press, particularly an offset sheet-fed printing press.

Referring now to the drawings and, first, particularly to FIG. 1, thereof, there is shown therein that, in order to feed a sheet 2 which has been lifted off a pile 1 thereof, the sheet 2 is directed onto a sheet-transport device 3, which passes the respective sheet 2 to a printing unit 4 of an offset sheet-fed printing press 5. An aligning device 6 cooperates with the sheet-transport device for bringing the thus fed sheet 2 into a reproducible position. In this position, the sheet 2 is then gripped by a gripper device 7, which is disposed on a cylinder 8 of the offset sheet-fed printing press 5. The cylinder 8 constitutes the impression cylinder 9 of the printing unit 4, which is located adjacent to a blanket cylinder 10 and a transfer cylinder 11 of the printing unit 4. The transfer cylinder 11 is followed by another transfer cylinder 12, and the blanket cylinder 10 cooperates with a plate cylinder 13.

The sheet-transport device 3, as shown in FIG. 1, is formed as a conveyor belt 14 with two guide rollers 16 and 17. Hold-down rollers 19 and 20 are assigned to an upper side 18 of the belt and, by means of a non-illustrated device, hold down a sheet 2 while it is being transported on the upper side 18, the sheet 2 having been taken from the pile 1 and fed to the sheet-transport device 3. During transport, the sheet 2 is fed to the aligning device 6 via a guide plate 50 which is disposed at the end of the sheet-transport device 3.

Figure 2:
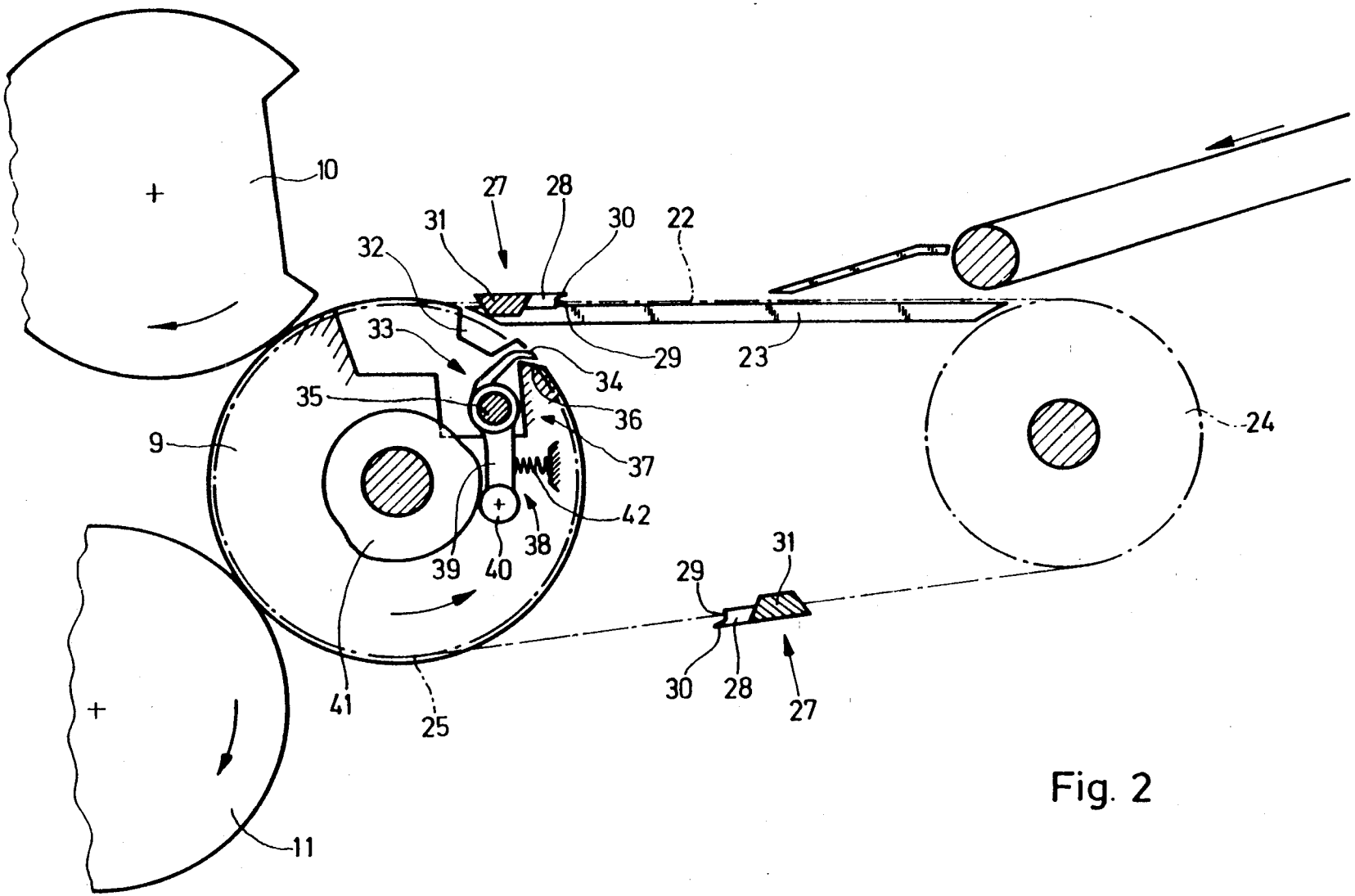
FIG. 2 is an enlarged fragmentary view of FIG. 1 showing the sheet-feeding system in greater detail.
Figure 6:
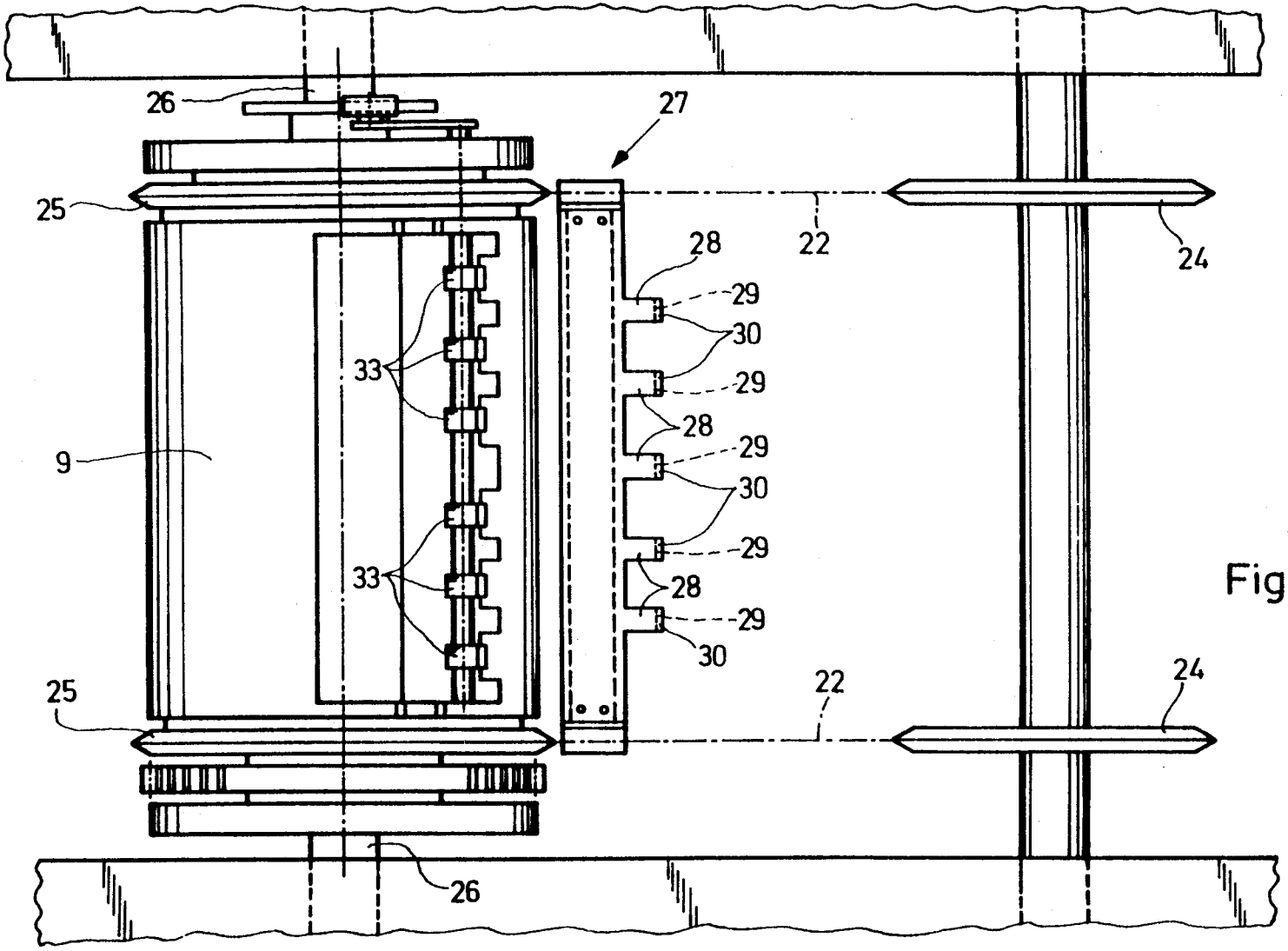
FIG. 6 is a top plan view of the sheet-feeding system.

The aligning device 6 is formed as an endless belt device 21. Particularly as shown in FIGS. 1, 2 and 6, two synchronously revolving belts 22 disposed in parallel with one another and having an upper belt strand or side, as shown in FIG. 2, with an underlying support 23. The two belts 22 are guided over guide wheels 24 and 25, a respective one of which, namely the guide wheel 25, is located in the vicinity of an end face of the impression cylinder 9. The belts 22 revolve at a speed which is synchronized with that of the impression cylinder 9. The impression cylinder 9 is rotatably mounted on fixed journals 26 (note FIG. 6).

The endless belt device 21 includes two aligning bridges 27 (FIGS. 2 and 6) which connect the two belts 22 to one another. Each aligning bridge 27 is comb-like in shape, with stop-forming front lays 29 being provided on a plurality of mutually spaced-apart, prong-like extensions 28. The front lays 29 are formed by end faces of the individual extensions 28, each of the end faces merging into a hold-down lug 30, which protrudes beyond the respective front lays 29.

Each of the aligning bridges 27 is formed of a bridge cross-piece 31 having a trapezoidal cross-sectional shape. A holding recess 32 is formed in the impression cylinder 9, and the respective bridge cross-piece 31 of the respective aligning bridges 27 is receivable therein with a precise fit during operation.

The gripper device 7 (FIG. 1) has a plurality of cylinder-installed grippers 33 (FIG. 6) which are mutually spaced apart in rows and arranged juxtaposed so that the extensions 28 of the aligning bridges 27 can pass between them. The extensions 28 and, accordingly, the front lays 29 are thereby positionable in a staggered relationship with respect to the grippers 33.

Each of the grippers 33 has a gripper finger 34, which is fastened to a common shaft 35. When the shaft 35 is rotated, ends of the gripper fingers 34 come into engagement with mating stop surfaces 36 formed on the impression cylinder 9. During the transport of the sheet 2, when the grippers 33 perform a closing motion, the sheet 2 is clamped between the ends of the gripper fingers 34 and the mating stop surfaces 36. Actuation of the associated gripper mechanism 37 by rotation of the common shaft 35 is accomplished through the intermediary of a lever 39 forming a sensing member 38 which is connected to the shaft 35 so as to be fixed against rotation relative thereto. The lever carries at its free end a roller 40 which runs on and around a fixed cam plate 41 when the impression cylinder 9 rotates. The lever 39 is subjected to the force of a compression spring 42 which presses the roller 40 against the cam plate 41.

Figure 3:
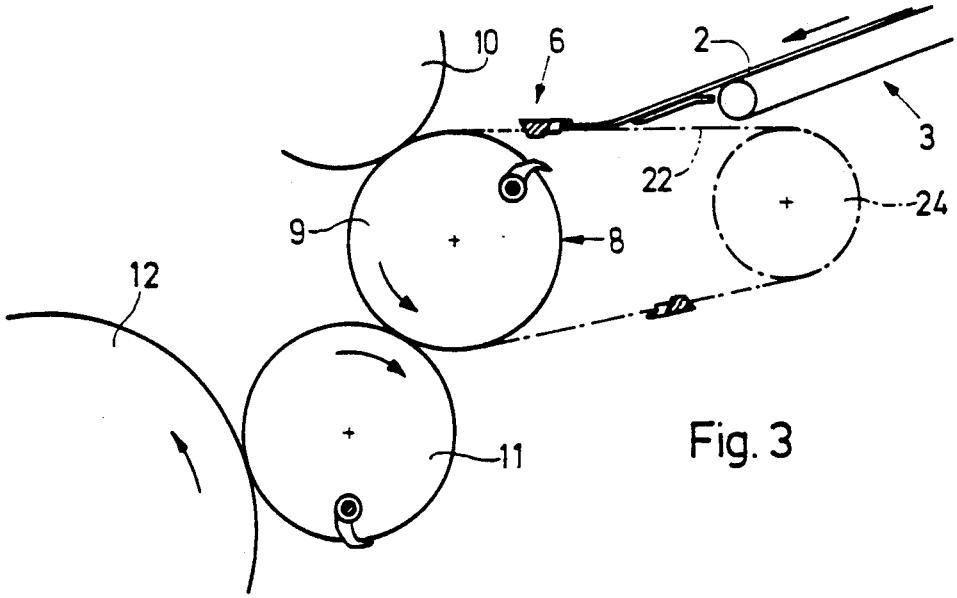
FIGS. 3 to 5 are slightly reduced fragmentary views of FIG. 1 showing the sheet feeding system in sequential operating phases thereof.
Figure 4:
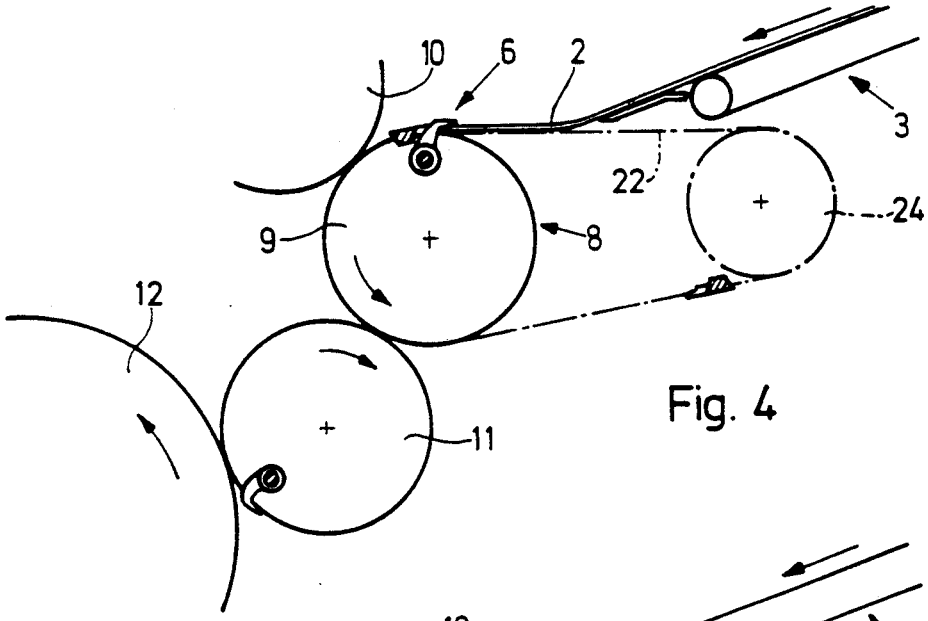
Figure 5:
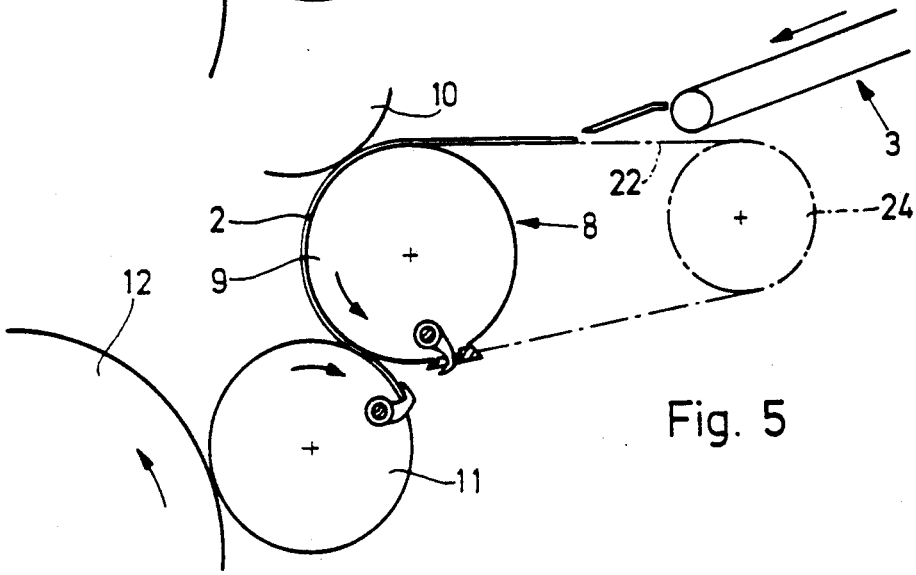

The device of the invention operates as follows: By means of the sheet-transport device 3, a sheet 2 is fed to the aligning device 6 in an operating cycle wherein the front edge of the sheet 2, as shown in FIG. 3, comes into contact with the front lays 29 of the appertaining aligning bridge 27. The sheet-transport device 3 has a feeding speed which ensures constant maintenance of the contact position of the leading edge of the sheet 2 against the front lays 29, as well as also during further movement of the aligning bridge 27 when the endless belt device 21 is in operation, the bridge cross-piece 31 of the aligning bridge 27 enters into the holding recess 32 formed in the impression cylinder 9, the individual extensions 28 assuming a position between the grippers 33, and the leading edge region of the sheet 2 entering into the spaces between the gripper fingers 34 and the mating stop surfaces 36 of the grippers 33 which ar in open position. Then, in the course of further rotation of the impression cylinder 9, the cam plate 41 controls the gripper mechanism 37 so that the grippers 33 assume the close position thereof wherein the sheet 2 is clamped. During the closing movement of the grippers 33, the contact position of the leading edge of the sheet 2 against the front lays 29 continues to be maintained, so that the sheet 2 is transferred to the impression cylinder 9 in a defined, reproducible manner. Before the grippers 33 close, it is possible, while retaining the contact position of the sheet 2, to align the sheet laterally by means of a non-illustrated lateral aligning device.

After the sheet 2 has been transferred, it is printed by coming into contact with the blanket cylinder 10 and, after it has been printed, it is passed to the transfer cylinder 11.

The foregoing is a description corresponding in substance to German Application P 41 14 479.1, dated May 3, 1991, the International priority of which is being claimed for the instant application, and which is hereby made part of this application. Any material discrepancies between the foregoing specification and the aforementioned corresponding German application are to be resolved in favor of the latter.

I claim:

1. Method of feeding, aligning and holding a sheet on a cylinder of a sheet-processing machine, which comprises, prior to an occurrence of a gripping operation on a sheet at a cylinder of a sheet-processing machine, moving front lays from a location forward of the cylinder, as viewed in a sheet travel direction through the machine, and guiding the front lays around the cylinder to a location above the cylinder, forcing a leading edge of the sheet into a contact position wherein the leading edge of the sheet is pressed against the moving front lays, opening sheet grippers carried by the cylinder, inserting the leading edge of the sheet which is in the contact position into the sheet grippers, and maintaining the leading edge of the sheet in the contact position with the front lays until just before closing the sheet grippers.

2. Method of feeding, aligning and holding a sheet on a cylinder of a sheet-processing machine, which comprises, prior to an occurrence of a gripping operation on a sheet at a cylinder of a sheet-processing machine, forcing a leading edge of the sheet into a contact position wherein the leading edge of the sheet is pressed against moving front lays which are guided over the cylinder, guiding the front lays around the cylinder, opening sheet grippers carried by the cylinder, inserting the leading edge of the sheet which is in the contact position into the sheet grippers, and maintaining the leading edge of the sheet in the contact position with the front lays until just before closing the sheet grippers.

3. Method of feeding, aligning and holding a sheet on a cylinder of a sheet-processing machine, which comprises, prior to an occurrence of a gripping operation on a sheet at a cylinder of a sheet-processing machine, forcing a leading edge of the sheet into a contact position wherein the leading edge of the sheet is pressed against moving front lays which are guided over the cylinder, opening sheet grippers carried by the cylinder, inserting the leading edge of the sheet which is in the contact position into the sheet grippers, moving the front lays between the grippers when inserting the leading edge of the sheet into the grippers, and maintaining the leading edge of the sheet in the contact position with the front lays until just before closing the sheet grippers.

4. Method of feeding, aligning and holding a sheet on a cylinder of a sheet-processing machine, which comprises, prior to an occurrence of a gripping operation on a sheet at a cylinder of a sheet-processing machine, forcing a leading edge of the sheet into a contact position wherein the leading edge of the sheet is pressed against moving front lays which are guided over the cylinder, opening sheet grippers carried by the cylinder, inserting the leading edge of the sheet which is in the contact position into the sheet grippers, maintaining the leading edge of the sheet in the contact position with the front lays until just before closing the sheet grippers, and moving the sheet at a speed higher than the speed of the front lays while continuously braking the higher speed of the sheet against the front lays.

5. Method of feeding, aligning and holding a sheet on a cylinder of a sheet-processing machine, which comprises, prior to an occurrence of a gripping operation on a sheet at a cylinder of a sheet-processing machine, forcing a leading edge of the sheet into a contact position wherein the leading edge of the sheet is pressed against moving front lays which are guided over the cylinder, opening sheet grippers carried by the cylinder, inserting the leading edge of the sheet which is in the contact position into the sheet grippers, maintaining the leading edge of the sheet in the contact position with the front lays until just before closing the sheet grippers, and laterally aligning the sheet while its leading edge is in the contact position with the front lays and prior to closing the grippers.

6. Device of feeding, aligning and holding a sheet on a cylinder of a sheet-processing machine, comprising means for feeding a sheet, means including front lays for aligning the sheet at a leading edge thereof, means for guidingly moving said front lays from a location forward of a cylinder of a sheet-processing machine, as viewed in a sheet travel direction through the machine, to a location above the cylinder, and gripper means having open grippers closable for gripping the sheet at a leading-edge portion thereof, a leading edge of the sheet being feedable by said feeding means into contact with said front lays of said aligning means, and a leading-edge portion of the sheet being insertable into said open grippers while the leading edge of the sheet remains in contact with said front lays of said aligning means and prior to a closing of said open grippers.

7. Device according to claim 6, wherein said sheet-feeding means are a sheet transport device formed as an endless conveyor belt.

8. Device according to claim 6, wherein said sheet-feeding means are a sheet transport device formed as a suction device.

9. Device according to claim 6, wherein said sheet-feeding means are a sheet transport device having a directed air cushion.

10. Device according to claim 6, wherein the cylinder is an impression cylinder of a sheet-fed printing machine.

11. Device according to claim 6, wherein said gripper means comprise a plurality of grippers mutually spaced apart in rows.

12. Device according to claim 6, wherein each of said front lays has a hold-down lug for holding the sheet down.

13. Device according to claim 6, including a gripper mechanism for opening and closing said grippers, a fixed cam plate, and a sensing member operatively connected to said gripper mechanism and movable along said fixed cam plate by rotation of the cylinder for operating said gripper mechanism.

14. Device for feeding, aligning and holding sheet on a cylinder of a sheet-processing machine, comprising means for feeding a sheet, means included front lays for aligning the sheet at a leading edge thereof, and gripper means having open grippers closable for gripping the sheet at a leading-edge portion thereof, a leading edge of the sheet being feedable by said feeding means into contact with said front lays of said aligning means, and a leading-edge portion of the sheet being insertable into said open grippers while the leading edge of the sheet remains in contact with said front lays of said aligning means and prior to a closing of said open grippers, said aligning means comprising a conveyor-belt device running over the cylinder.

15. Device according to claim 14, wherein said conveyor-belt device comprises two parallel, synchronously revolving endless belts, and at least one aligning bridge connecting said conveyor belts to one another, said aligning bridge being formed with said front lays.

16. Device according to claim 15, wherein said aligning bridge is movable past the cylinder, the cylinder is formed with a holding recess, and said aligning bridge is formed with a bridge cross-piece receivable in said holding recess with a precise fit when said aligning bridge passes the cylinder.

17. Device according to claim 15, wherein said aligning bridge has a comb-like shape, said front lays thereof forming stops and being disposed on a plurality of spaced-apart prong-like projections of said comb-like aligning bridge.

* * * * *